US008228210B2

(12) United States Patent
Sitbon

(10) Patent No.: US 8,228,210 B2
(45) Date of Patent: Jul. 24, 2012

(54) CROSSING LOCATED ALERT SYSTEM USING FOG AND GENERATED LIGHT

(75) Inventor: David E. Sitbon, Beer Sheva, IL (US)

(73) Assignee: Red Wall Ltd., Beer Sheva (IL)

( * ) Notice: Subject to any disclaimer, the term of this patent is extended or adjusted under 35 U.S.C. 154(b) by 546 days.

(21) Appl. No.: 12/496,424

(22) Filed: Jul. 1, 2009

(65) Prior Publication Data

US 2009/0273486 A1 Nov. 5, 2009

Related U.S. Application Data

(63) Continuation-in-part of application No. PCT/IL2008/000659, filed on May 12, 2008.

(51) Int. Cl.
*G08B 21/00* (2006.01)

(52) U.S. Cl. ..... 340/907; 340/944; 362/259

(58) Field of Classification Search ..... 340/907–908.1, 340/944, 925, 691.1–691.3; 362/259; 116/63 R
See application file for complete search history.

(56) References Cited

U.S. PATENT DOCUMENTS

| | | | |
|---|---|---|---|
| 5,917,622 | A | 6/1999 | Diffin et al. |
| 5,963,345 | A | 10/1999 | Smith |
| 2004/0027828 | A1 | 2/2004 | Awa |
| 2006/0267795 | A1 | 11/2006 | Draaijer et al. |

FOREIGN PATENT DOCUMENTS

| | | | |
|---|---|---|---|
| DE | 197 36 270 | A1 | 3/1998 |
| GB | 450331 | | 7/1936 |
| WO | WO2008/139470 | A1 | 11/2008 |

*Primary Examiner* — Jeffery Hofsass
(74) *Attorney, Agent, or Firm* — Marsteller & Associates, P.C.

(57) ABSTRACT

An alert system for generating, in the vicinity of a crossing such as an intersection or a railcar station warning line, a wide-area image indicative of an actual or impending traffic safety problem, comprising at least one safety indication component for indicating a state of an actual or impending safety problem; at least one wide-area image generating device mounted in the vicinity of the crossing for generating a corresponding vertically appearing wide-area image appearing at an injury preventable distance from the crossing; fog generating apparatus mounted in the vicinity of the crossing for discharging vaporized fluid by which light of a corresponding generated wide-area image is refracted or reflected, so that the wide-area images will be visible during daytime light; and a controller in communication with the at least one safety indication component for synchronizing operation of the at least one wide-area image generating device and the fog generating apparatus.

23 Claims, 15 Drawing Sheets

CROSSING LOCATED ALERT SYSTEM USING FOG AND GENERATED LIGHT

FIELD OF THE INVENTION

The present invention relates to the field of traffic safety. More particularly, the invention relates to a system for generating a wide-area image appearing at a crossing, in order to provide, for example, an indication of the state of a given traffic light and/or to provide an alert as to a potential or impending safety problem.

BACKGROUND OF THE INVENTION

Many traffic accidents result from the inability of drivers to view the state of a traffic light, e.g. whether the traffic light indicates a red light or a green light, due to sun glare, poor visibility such as during a snow storm, or driver drowsiness. It would be desirable to display a visible alert to a driver that is indicative of the state of a traffic light and/or is indicative of a potential or impending safety problem, such as the approach of a train at a railway grade crossing, upcoming traffic congestion resulting from the placement of a traffic barrier by the police, due to an accident, or resulting from the presence of an obstacle on the road, the presence of an intersection within a tunnel or at an airport runway, the presence of a pedestrian crossing, and the presence of a school bus from which children are disembarking.

U.S. Pat. No. 5,963,345 discloses a holographic warning indicator including a transmission hologram decal that is mounted on a front or rear window of a vehicle. A lamp projects a beam of light downward onto the hologram, and the latter projects a conspicuous image, such as the word "STOP", to warn drivers of other vehicles that the hologram bearing vehicle has come to a stop. Needless to say, such an indicator is not helpful for displaying an alert signal to the driver of the first vehicle that approaches an intersection at which a traffic light is not clearly visible.

US 2006/0267795 discloses a traffic information system for conveying information to drivers. A controllable beam deflection system directs a light beam towards a projection area on a road surface, and a controllable pattern can be projected. Such a pattern is not always visible, due to varying road conditions or a driver's field of view that does not coincide with the road surface. Also, the display of the projected pattern on the road surface does not provide the driver with a sensation that an immediate reaction may be necessary, during those situations, for example, when a traffic light is not visible.

US 2004/027828 discloses an indication apparatus that can make a clear distinction between a sidewalk and a driveway by using a beam going straight on, and that can make drivers recognize the existence of a pedestrian crossing. A support of a corresponding light emitting system is erected on the four corners of a pedestrian crossing so that a horizontal beam emitted between two light emitting systems is generated above the pedestrian crossing. Such an indication apparatus is not suitable for alerting a driver at an intersection of a many laned road since the same image would appear above each of the lanes and would not be beneficial to two drivers of adjacent lanes that are directed by two traffic lights, respectively, having a different state. Also, a generated image may not visible during bright daytime light.

It is an object of the present invention to provide a system for generating a wide-area image appearing in an intersection, to provide an indication of the state of a given traffic light.

It is an additional object of the present invention to provide a system for generating a visible alert which causes a driver to react immediately in response to a changing state of a traffic light.

It is an additional object of the present invention to provide a system for generating a visible alert which causes a driver to react immediately in response to a potential or impending safety problem, such as the approach of a train at a railway grade crossing, upcoming traffic congestion, the presence of an intersection within a tunnel or at an airport runway, the presence of a pedestrian crossing, and the presence of a school bus from which children are disembarking.

It is an additional object of the present invention to provide a system for generating a clearly visible crossing-located, wide-area image which is not influenced by the instantaneous road or weather conditions.

Other objects and advantages of the invention will become apparent as the description proceeds.

SUMMARY OF THE INVENTION

The present invention provides an alert system for generating, in the vicinity of a crossing, a wide-area image which is indicative of an actual or impending safety problem.

As referred to herein, a "crossing" is a location whereat the path of a person or a propelled vehicle is liable to coincide with another person or propelled vehicle headed in a different direction. A crossing is included in the group consisting of, but is not limited by, an intersection, a pedestrian crossing, a bus stop, the warning line of a railcar station, a grade crossing, a holding line at a runway, and a port. When another person or propelled vehicle (hereinafter "object") is located within the confines of the crossing and will collide with a first object if a vehicular speed or the walking or running speed of a person (hereinafter "body speed") is not reduced, there exists an "actual safety problem". When another object is located outside the confines of the crossing and will collide with the first object if a vehicular or body speed is not reduced, there exists an "impending safety problem". Examples of an impending safety problem include traffic congestion, a slippery road, and a malfunctioning traffic light.

The alert system comprises at least one safety indication component for indicating a state of an actual or impending safety problem. A "safety indication component" such as a traffic light may be operated by a traffic regulation authority to increase the safety of objects passing through a crossing. Alternatively, a safety indication component may be one or more sensors that indicate an actual or impending safety problem. A "state" of an actual or impending safety problem may be binary, i.e. indicative whether a safety problem exists or does not exist. Alternatively, the state of an actual or impending safety problem may be discrete, i.e. one may be presented with several options.

At least one wide-area image generating device mounted in the vicinity of a crossing is adapted to generate a corresponding vertically appearing wide-area image that appears at an injury preventable distance from said crossing. The "injury preventable distance" is generally set in accordance with an average speed of an object approaching the crossing that would initiate a collision. By suddenly generating in the vicinity of the crossing, in response to an indication of an actual or impending safety problem, a vertically appearing "wide-area image" being suggestive of a barrier, the height and width of which are greater than or equal to the height and width, respectively, of an object entering the crossing, the viewer is caused to instinctively reduce a vehicular or body speed and to thereby prevent an injury.

When the object is a driven vehicle and the crossing is an intersection, for example, the sensation is induced that the driven vehicle is seemingly about to collide with barrier, causing the driver to instinctively depress the brake pedal of the driven vehicle. The quickness to react of a viewer will generally increase as the size of the wide-area image increases.

The alert system also comprises fog generating apparatus mounted in the vicinity of said crossing for discharging vaporized fluid by which light of said corresponding generated wide-area image is refracted or reflected, whereby each of said generated wide-area images is visible during daytime light, and a controller in communication with said at least one safety indication component for synchronizing operation of said at least one wide-area image generating device and said fog generating apparatus in response to a safety indication provided by said component, whereby at least one daytime visible wide-area image is generated at said injury preventable distance from said crossing so as to assist a viewer to respond in anticipation of said actual or impending safety problem.

The fog generating apparatus and a wide-area image generating device are advantageously used for generating a daytime visible wide-area image to assist a viewer to respond in anticipation of an actual or impending safety problem, vaporized fluid discharged from said fog generating apparatus causing light emitted from said wide-area image generating device to be refracted or reflected. The vaporized fluid is generally pressurized so as to be discharged from a corresponding outlet to a predetermined propelled dimension.

In one embodiment, the at least one safety indication component is a traffic light provided with a plurality of sequentially illuminating lamps, one or more of said traffic lights being deployed at an intersection, and the at least one daytime visible wide-area image is generated at the injury preventable distance from said intersection and appears above, and within the boundaries of, a corresponding lane passing through said intersection and that is indicative of the state of a corresponding traffic light.

A first wide-area image is displayable by means of a first wide-area image generating device in a first lane and a second wide-area image different from said first wide-area image is displayable by means of a second wide-area image generating device in a second lane adjacent to said first lane, vehicles traveling in said first and second lanes travel in the same direction.

In one aspect, each wide-area image generating device comprises one or more light emission units, each of said light emission units comprising a light source and means for directing the emitted light to the injury preventable distance from the crossing.

In one aspect, each light emission unit comprises a high-luminosity, non-coherent light source, and optical elements for focusing and reflecting the light from the light source along an axial direction to define a wide-area image having a predetermined width and height.

In one aspect, each light emission unit comprises a hologram generating unit, to define a wide-area image having a predetermined width and height.

In one aspect, each wide-area image generating device comprises a lens and a plurality of light-emitting diodes placed at the focal length of said lens. The lens may be a cylindrical lens or a spherical lens.

In one aspect, a generated wide-area image is indicative of the instantaneous state of a corresponding traffic light.

In one aspect, a generated wide-area image is indicative of a state to which a corresponding traffic light will be changed within a predetermined period of time, e.g. within 2 seconds.

In one aspect, each wide-area image generating device is mounted within an arm extending from a traffic light mounting pole and is adapted to downwardly direct the emitted light in such a way that the generated image appears above, and within the boundaries of, a corresponding lane adjacent to the intersection.

In one aspect, the fog generating apparatus and the at least one wide-area image generating device are mounted within a traffic light mounting pole, the vaporized fluid and emitted light being laterally directed in such a way that the generated daytime visible wide-area image appears above, and within the boundaries of, a corresponding lane adjacent to the intersection.

In one aspect, the fog generating apparatus and the at least one wide-area image generating device are mounted within a cavity formed below a road surface in the vicinity of a stop line.

In one aspect, the wide-area image generating device is adapted to generate a corresponding wide-area image that appears a predetermined distance before the stop line.

In one aspect, an upper surface of each wide-area image generating device is coplanar with, or slightly below, a road surface in the vicinity of the stop line.

In one aspect, the system further comprises a voice generating device in communication with the controller that is activated in response to a safety indication provided by the component.

In one aspect, the crossing is a grade crossing or a pedestrian crossing.

In one aspect, indicia are displayable on a wide-area image foreground.

In one aspect, the wide-area image is in the form of still or video images.

In one aspect, the alert system further comprises a light detector, said light detector adapted to transmit a signal to the controller when a sensed light level is greater than a predetermined threshold, whereby to increase a level of current flowing through the wide-area image generating device and to increase the luminosity of the wide-area image.

In one aspect, the controller is adapted to command the wide-area image generating device to generate a wide-area image of a different color than the lamp of the corresponding traffic light which is illuminated.

In one embodiment, the fog generating apparatus and the at least one wide-area image generating device are mounted within a portion of a school bus and the at least one safety indication component includes an engine ignition sensor and a door open sensor, the fog generating apparatus and the at least one wide-area image generating device being operable to automatically generate a daytime visible wide-area image laterally extending from the school bus when the door of the school bus is open and the school bus engine is operational.

In one embodiment, the at least one safety indication component is a crossing predictor component for determining an arrival time of a railcar at a station and the at least one daytime visible wide-area image is generatable at an injury preventable distance from a warning line of said station and at a predetermined time prior to said arrival time.

In one aspect, the light detector is adapted to transmit a signal to the controller when a sensed light level is less than a predetermined threshold, whereupon operation of the fog generating apparatus will be disabled in response to a safety indication provided by the component.

In one embodiment, the alert system comprises at least one safety indication component for indicating a state of an actual or impending safety problem; at least one wide-area image generating device mounted in the vicinity of a crossing for generating a corresponding vertically appearing wide-area image that appears at an injury preventable distance from said crossing; and a controller in communication with said at least one safety indication component for synchronizing operation of said at least one wide-area image generating device in response to a safety indication provided by said component, whereby at least one daytime visible wide-area image is generated at said injury preventable distance from said crossing so as to assist a viewer to respond in anticipation of said actual or impending safety problem.

In one embodiment, the alert system comprises at least one safety indication component for indicating a state of an actual or impending safety problem; fog generating apparatus mounted in the vicinity of a crossing for discharging visible vaporized fluid at an injury preventable distance from said crossing; and a controller in communication with said at least one safety indication component for synchronizing operation of said fog generating apparatus in response to a safety indication provided by said component, so as to assist a viewer to respond in anticipation of said actual or impending safety problem.

DETAILED DESCRIPTION OF PREFERRED EMBODIMENTS

The present invention is an intersection-located driver alert system and method to minimize traffic accidents. A wide-area image, which may appear as a vertically disposed optical (or any other virtual) barrier, is generated at an intersection, or at any other location associated with an actual or a potential traffic safety problem. A driver who approaches the intersection clearly sees the image, regardless of weather or road conditions, and is alerted as to the state of the given traffic light. The sudden appearance of a red (or any other colored) barrier at the intersection, for example, induces the sensation that the driven vehicle is seemingly about to collide with the optical/virtual barrier, causing the driver to instinctively depress the brake pedal of the driven vehicle. The alerts provided by the system proposed by the present invention may also include messages (in the form of still or video images) that are related to specific important information (such as wet or closed road ahead, accident 500 m ahead) and any other useful information that may help the observer to be aware of.

Figure 1:
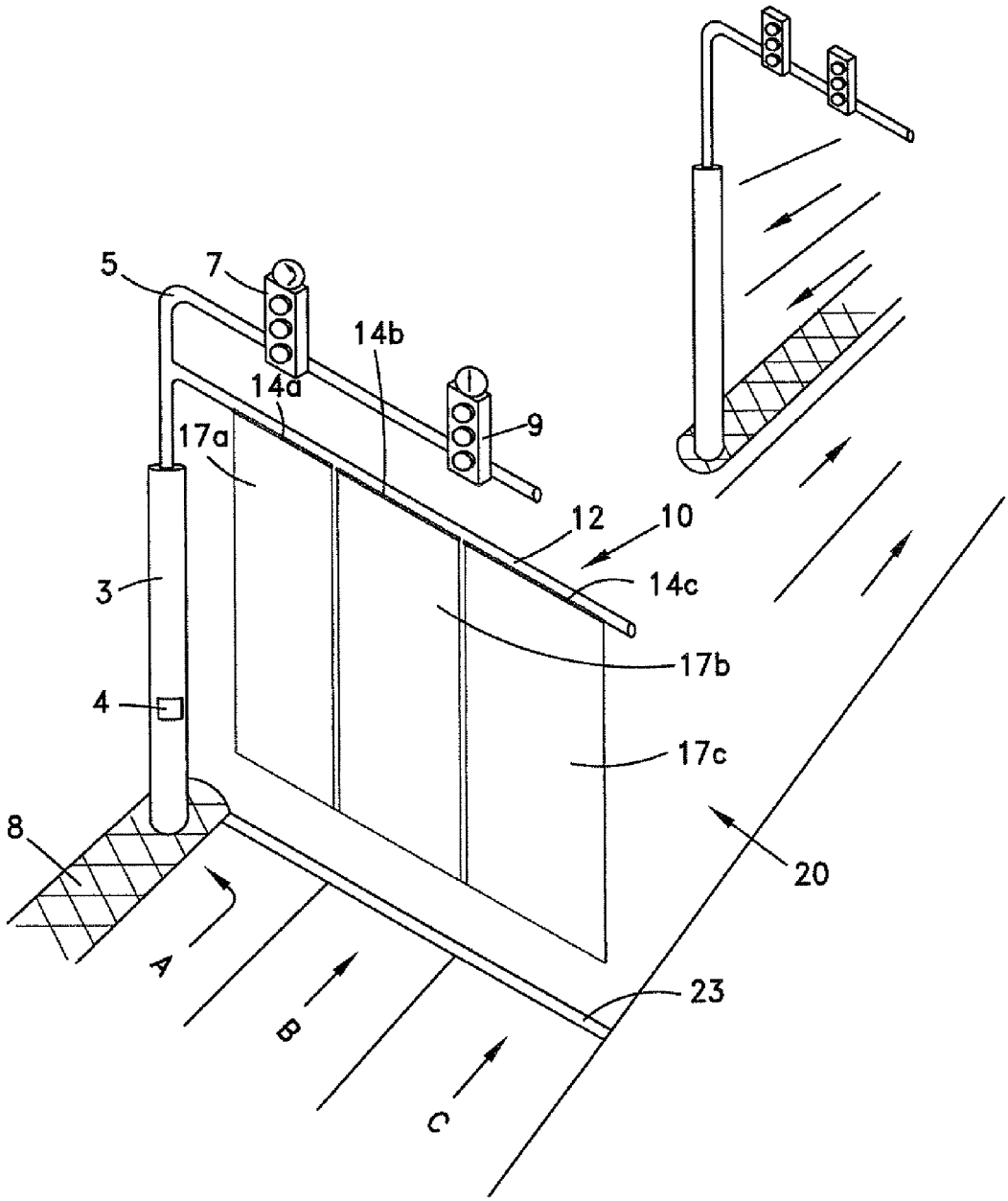
FIG. 1 is a perspective schematic view of a driver alert system, according to one embodiment of the invention.

FIG. 1 schematically illustrates one embodiment of the driver alert system of the present invention, which is designated by numeral 10, and the generation of a plurality of optical/virtual barriers thereby.

Driver alert system 10 comprises vertical mounting pole 3 that supports an upper arm 5 to which is attached traffic lights 7 and 9 and a lower arm 12 to which is attached wide-area image generating devices 14*a-c*. Mounting pole 3 is disposed in the vicinity of intersection 20, and vertically extends from traffic island 8, which separates the vehicular traffic traveling in two separate directions. Three lanes A, B, and C for traffic traveling in the same direction are illustrated, wherein vehicles in lane A are intended to turn left, while vehicles in lanes B and C are intended to continue traveling in a forward direction, passing through intersection 20.

Traffic lights 7 and 9 have a plurality of lamps, each of which displays a predetermined color and/or arrow, such as a red, yellow and green color, as is customary. Controller 4 embedded within mounting pole 3 transmits a signal to each of these lamps, to be illuminated in accordance with a cycle selected by a transportation authority. This cycle may be predetermined, and may be synchronized by means of a timing circuitry. The cycle may also be dynamically controlled in response to sensors that detect the presence of vehicles standing at a traffic light or the presence of a traffic jam. As shown, traffic light 7 directs the vehicles traveling along lane A, and traffic light 9 directs the vehicles traveling along lanes B and C.

Wide-area image generating devices 14*a-c* are adapted to generate vertically appearing wide-area images 17*a-c*, respectively, above stop line 23, which is adjacent to intersection 20. Each of the wide-area images 17*a-c* is directed to, and has boundaries within, lanes A-C, respectively, such that the width of a wide-area image is slightly less than that of the corresponding lane. Wide-area image generating devices 14*a-c* are connected to controller 4, so that wide-area images 17*a-c* are similar to the image displayed by a corresponding illuminated traffic light lamp. As shown, wide-area image 17*a* is similar to an illuminated lamp of traffic lamp 7 and wide-area images 17*b-c* are similar to the illuminated lamp of traffic light 9. For example, wide-area image 17*a* may be displayed as a green left arrow, while wide-area images 17*b-c* may be displayed as a uniform red image, appearing as a red curtain which tends to invoke an instinctive reaction by which the driver avoids entering the virtual barrier. The wide-area image is visible at a distance from stop line 23, and advantageously provides the driver with increased reaction time.

A wide-area image may be displayed as a different color than that of the traffic light lamp. Since controller 4 is in communication with timing circuitry, controller 4 may command image generating devices 17*b-c*, for example, to change their displayed color from green to yellow a predetermined time before traffic light 9 changes its displayed color, to indicate to drivers that they should reduce the speed of their vehicle being driven.

It will be appreciated that a wide-area image generating device may be deployed on, or slightly below, a road surface in the vicinity of the stop line, so that the wide-area image generated thereby will appear above the generating device. A wide-area image generating device may also be embedded within a mounting pole, so that the wide-area image generated thereby will be laterally projected (for example, in case of pedestrians' crossing areas).

The use of driver alert system 10 in tunnels, particularly in tunnels having underground intersections, can also prevent life-threatening accidents. Tunnels are generally poorly lit, and many drivers are confused when having to make a turn within the tunnel to a branch road, e.g. which leads to a different mountain. During a period of uncertainty, a vehicle may be in two lanes, may stall, may make an incorrect turn, or may not know the correct lane division, and therefore risks a collision with another vehicle. A bright wide-area image can be seen at a distance within a tunnel, and can therefore the decision making ability of a driver within a tunnel can be dramatically increased.

Figure 2:
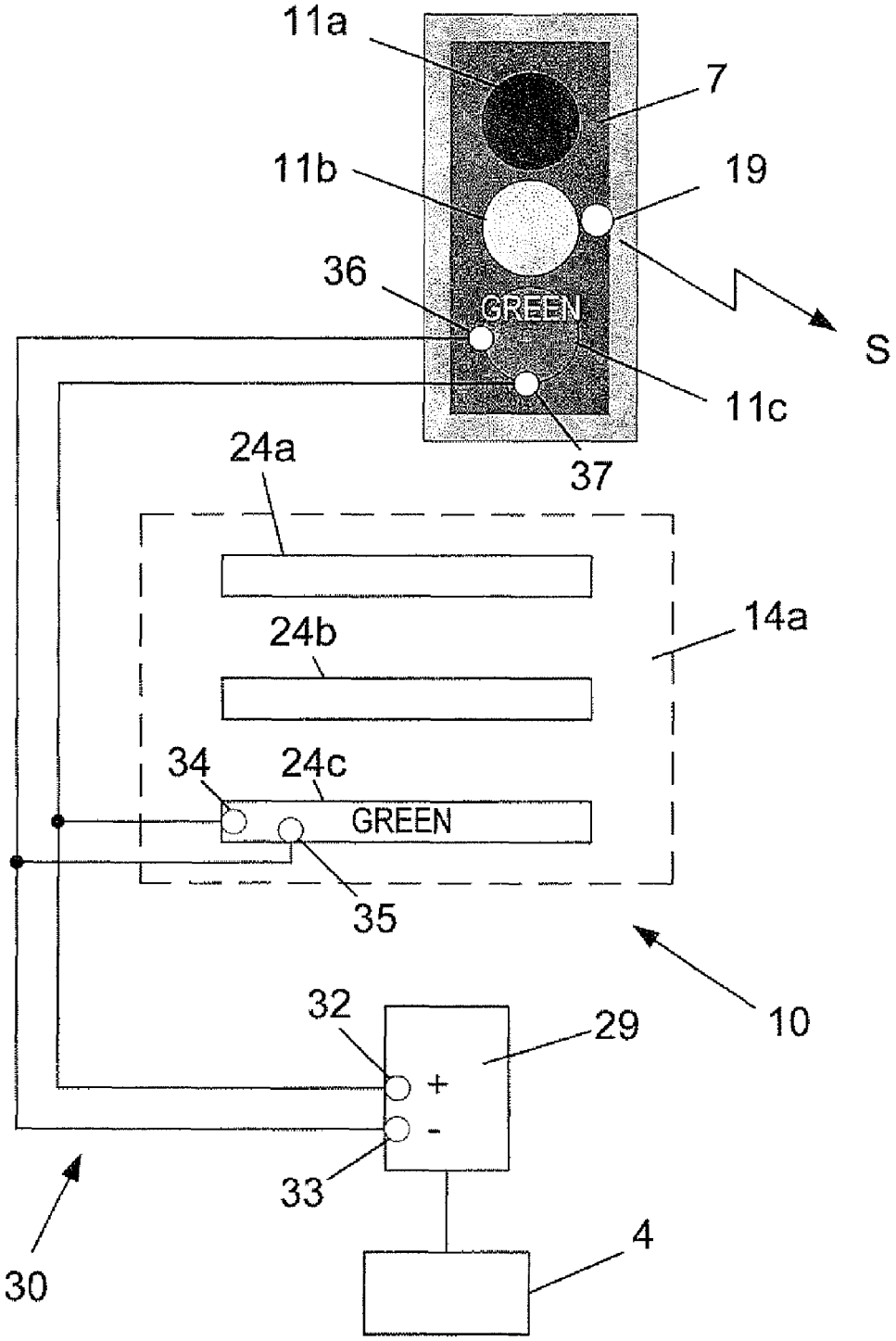
FIG. 2 is a block diagram of a driver alert system, illustrating an exemplary wiring arrangement for a portion of a wide-area image generating device.

FIG. 2 illustrates a block diagram of driver alert system 10, illustrating an exemplary wiring arrangement for a portion of wide-area image generating device 14*a*, which comprises three light emission units 24*a-c*. Controller 4 is connected to switching device 29. Switching device 29 in turn is connected in parallel to three circuits for the three lamps 11*a-c*, respectively, of traffic light 7, one of which, circuit 30, being illustrated. It will be appreciated that a switching device may be provided for each traffic light of the driver alert system, or alternatively, switching device 29 may be adapted to connect the lamps of the other traffic lights of the driver alert system as well. In circuit 30, the positive terminal 32 of switching device 29 is connected in parallel to the positive terminal 34 of light emission unit 24*c* and to the positive terminal 37 of lamp 11*c*. The negative terminal 33 of switching device 29 is connected in parallel to the negative terminal 35 of light emission unit 24*c* and to the negative terminal 36 of lamp 11*c*. Thus when controller 4 receives a signal that lamp 11*c* of traffic light 7 is to be illuminated, controller 4 commands switching device 29 to close circuit 30, causing lamp 11 to display a green light and light emission unit 24*c* to simultaneously generate a green wide-area image above the stop line of an intersection. The other light emission units are also configured to generate a wide-area image which displays a similar image as that displayed by the traffic light lamp connected thereto.

Traffic light 7 may be provided with a light detector 19. When the light level sensed by detector 19 is greater than a predetermined threshold which is generally indicative of daytime light or sun glare, a signal S, e.g. a wireless signal, is transmitted to controller 4, whereupon the current flowing through circuit 30 is increased so as to correspondingly increase the luminosity of the wide-area image.

In one embodiment, each light emission unit comprises a high-luminosity, non-coherent light source, such as a metal halide lamp, and optical elements for focusing and reflecting the light from the light source along a downward axial direction to define a wide-area image having a predetermined width and height.

Figure 3:
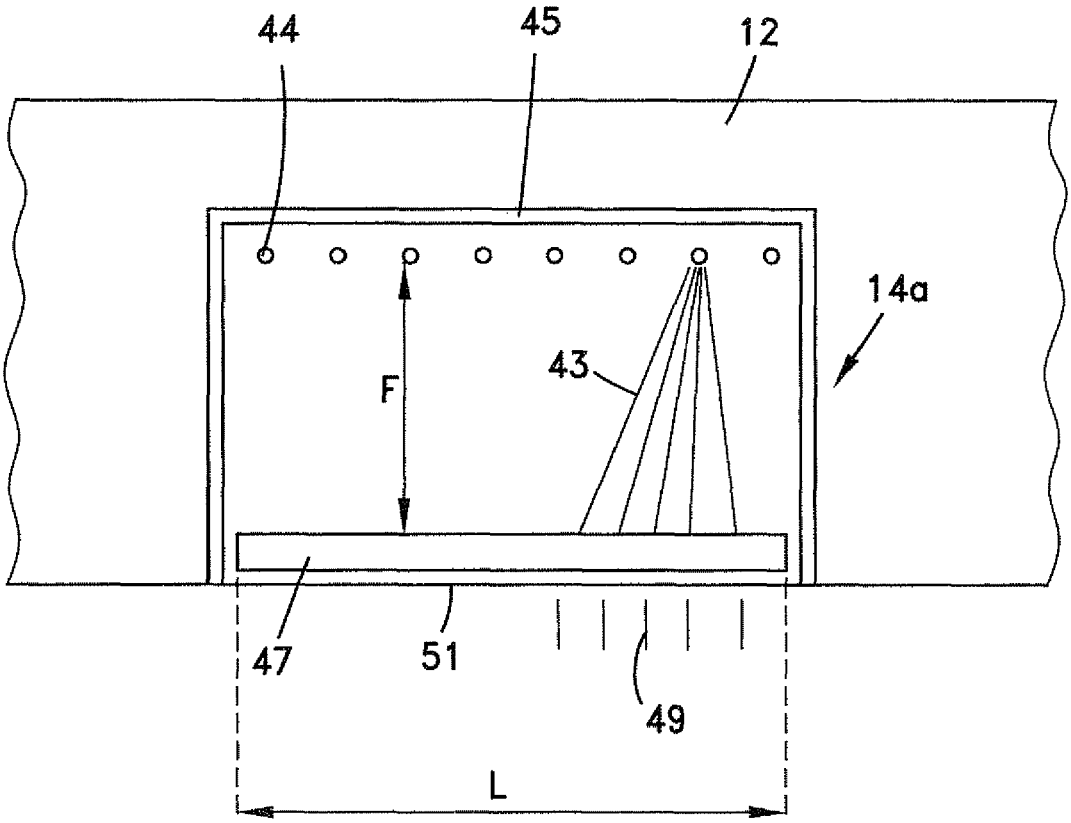
FIG. 3 is a schematic diagram of an exemplary wide-area image generating device which comprises a plurality of high-intensity light-emitting diodes.

FIG. 3 illustrates an exemplary wide-area image generating device 14*a*, which comprises a cylindrical lens 47, a plurality of high-intensity light-emitting diodes (LEDs) 44 placed at the focal length F of lens 47, and a housing 45 to which LEDs 44 and lens 47 are attached. Housing 45 is embedded within arm 12 extending from the mounting pole of the traffic light. Cylindrical lens 47 converts the emission 43 from each LED 44 into a beam of parallel rays which propagate through transparent transmitting element 51, e.g. glass, attached to housing 45. As the length of both the array of LEDs 44, i.e. from the first to last LED, and of cylindrical lens 47 is L, the wide-area image generated by device 14*a*, which is defined by the rays emitted by each LED 44, also has a length L.

Alternatively, coherent light beams, such as laser beams or plasma laser beams, may be solely used or used in combination with non-coherent light, to generate the desired wide-area image.

In addition, the wide-area image may be generated by a light projecting device, such as a lens, a reflective element and a refractive element, for projecting the light generated by a light emission unit.

Moreover, the system of the present invention may also include audile alerting means, such as a buzzer, or any other voice generating device, that is activated in combination with the visual alerting means provided to the driver or to a pedestrian, to increase the alerting effect and his attention to an actual or an impending safety problem.

In another embodiment, each light emission unit comprises a hologram generating unit, such as one produced by Liti Holographics, USA, to define a wide-area image having a predetermined width and height. By employing a hologram generating unit, indicia, such as an arrow indicating the direction of travel or numbers representing the number of seconds remaining until the color of the traffic light lamp will change, may be displayed on the foreground of the wide-area image while the color of the traffic light lamp will be displayed on the background thereof. The wide-area image may appear a predetermined distance before the stop line, to provide drivers an even increased reaction time.

Figure 15A:
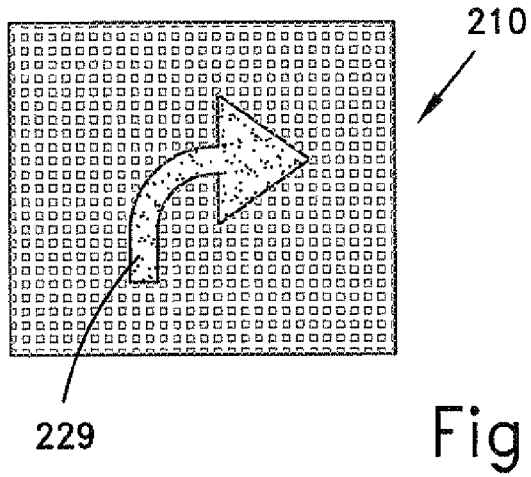
FIG. 15A schematically illustrates a pixel addressable mask which is selectively activated to define desired indicia.
Figure 15B:
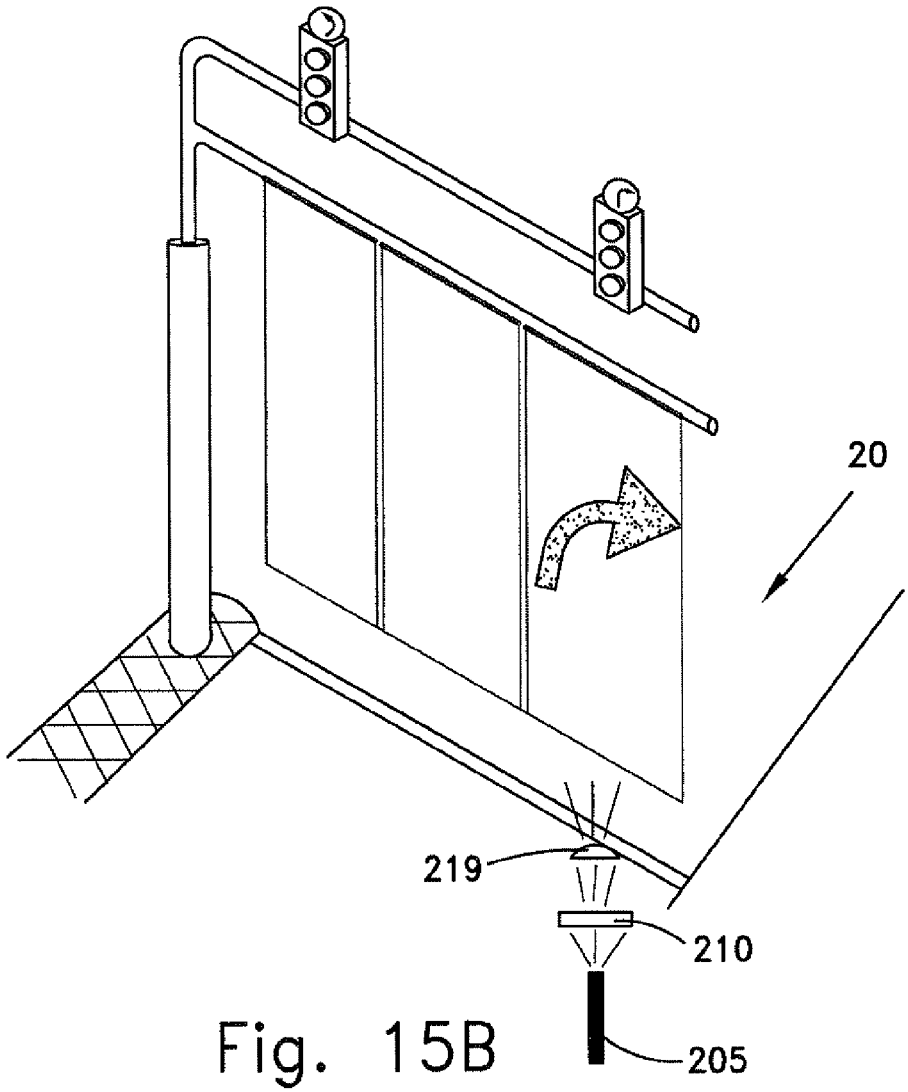
FIG. 15B schematically illustrates the generation of a wide-area image displaying indicia in its foreground by means of the mask of FIG. 15A.

As shown in FIGS. 15A and 15B, indicia 229 may be displayed on the foreground of a wide-area image by means of a pixel addressable mask 210. Mask 210 may be interposed between light source 205 and lens 219, so that indicia 229 may be displayed on wide-area image 223, such as at an intersection 20.

Figure 4:
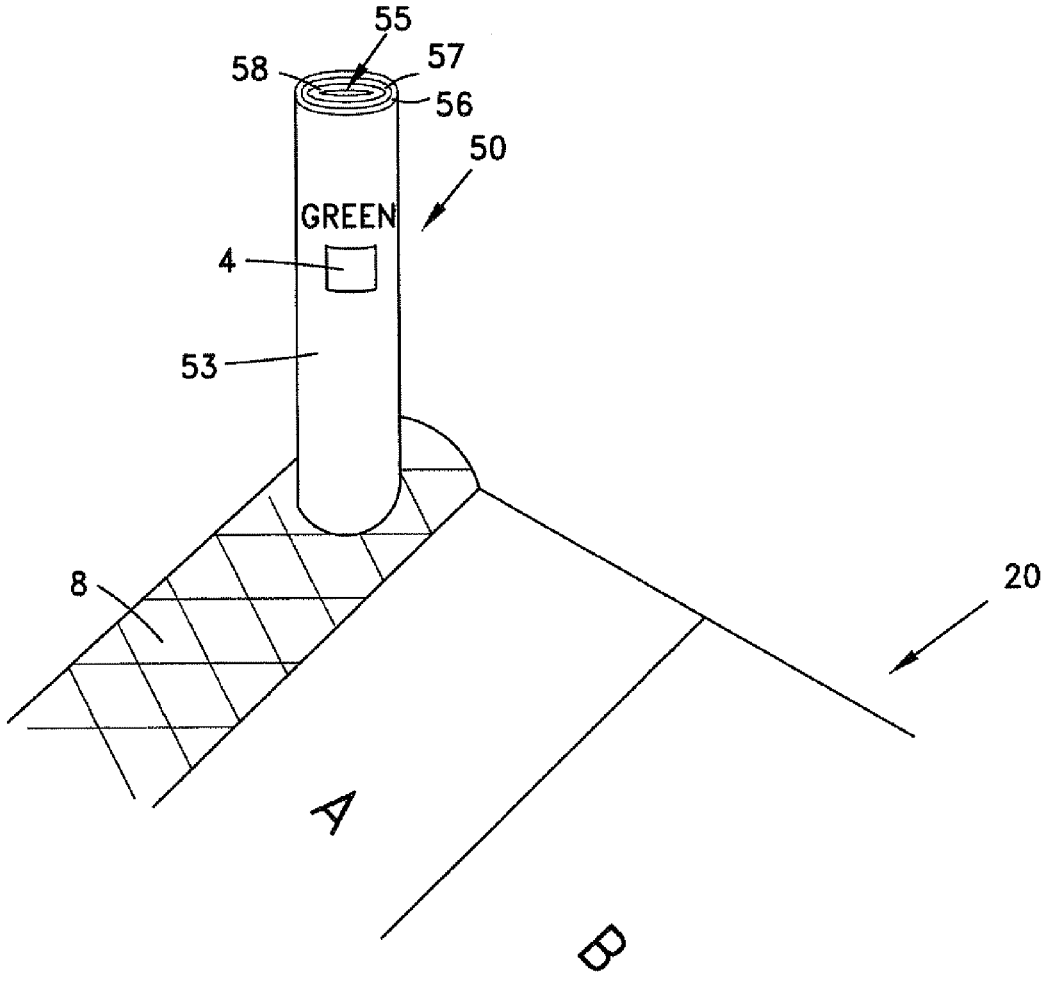
FIG. 4 is a perspective, cross sectional schematic view of another embodiment of a wide-area image generating device embodied by a casing of a traffic light mounting pole, illustrating a bottom portion of the mounting pole and a plurality of layers comprising the casing.

FIG. 4 illustrates another embodiment of the invention in which the wide-area image generating device is a casing of a traffic light mounting pole. As shown, driver alert system 50 comprises mounting pole 53 vertically extending from traffic island 8 and supporting a traffic light, casing 55 attached to the exterior of mounting pole 53, and controller 4 embedded in mounting pole 53 or located in any other convenient location, for transmitting a signal which is indicative of the state of the traffic light to controllably displayable casing 55. At times, a traffic light is mounted above mounting pole 53, and at the side of intersection 20 such as above traffic island 8, and may not be visible due to sun glare or inclement weather. A wide-area image of bright colors that is generated on casing 55 is clearly visible to drivers traveling along one of lanes A and B and will therefore alert the drivers as to the state of the traffic light. In the illustrated example, a bottom portion of mounting pole 53 is shown is perspective, cross section view, and casing 55 comprises three light emission units 56, 57, and 58, each of which is adapted to display a single color when activated. When light emission unit 58, for example, is activated by controller 4, as described hereinabove with respect to FIG. 2, light emission units 56 and 57 are transparent and the image generated by light emission unit 58 is visible. It will be appreciated that casing 55 may be embodied by a single light emission unit which controllably displays the same color displayed by the corresponding traffic light, or any other display which indicates the state of the corresponding traffic light.

Casing 55 may be tubular such that it surrounds the entire periphery of mounting pole 53, or it may be arcuate such that it is mounted to the side of mounting pole 53 which faces the drivers of the oncoming traffic.

An exemplary light emission unit suitable for a controllably displayable casing 55 of controllably displayable casing 55 may comprise an electro-optical conductive polymer layer well known to those skilled in the art. When controller 4 applies a predetermined voltage to the conductive polymer layer connected therewith, a color corresponding to the predetermined voltage is displayed. In response to a change in state of the corresponding traffic light, the controller is disconnected from the first conductive polymer layer and is connected to a second layer, applying a different predetermined voltage so that casing 55 will display a different color. Alternatively, casing 55 may comprise a liquid crystal display (LCD) panel, which may display a wide-area image of uniform color, or provided with indicia such as an arrow having a different color than the background of the wide-area image.

In another embodiment of the invention, the wide-area image may be made visible during daytime light by generating a fog screen, by which the light emitted by a wide-area image generating device is refracted or reflected so as to display the desired image. The fog screen may be generated by the atomization or vaporization of water drops, or any other desired liquid or gaseous fluid. The fog screen can be generated below the road surface and then propelled thereabove, generated above the road surface and then propelled downwardly, or generated from the side of the road and propelled laterally.

Figure 5:
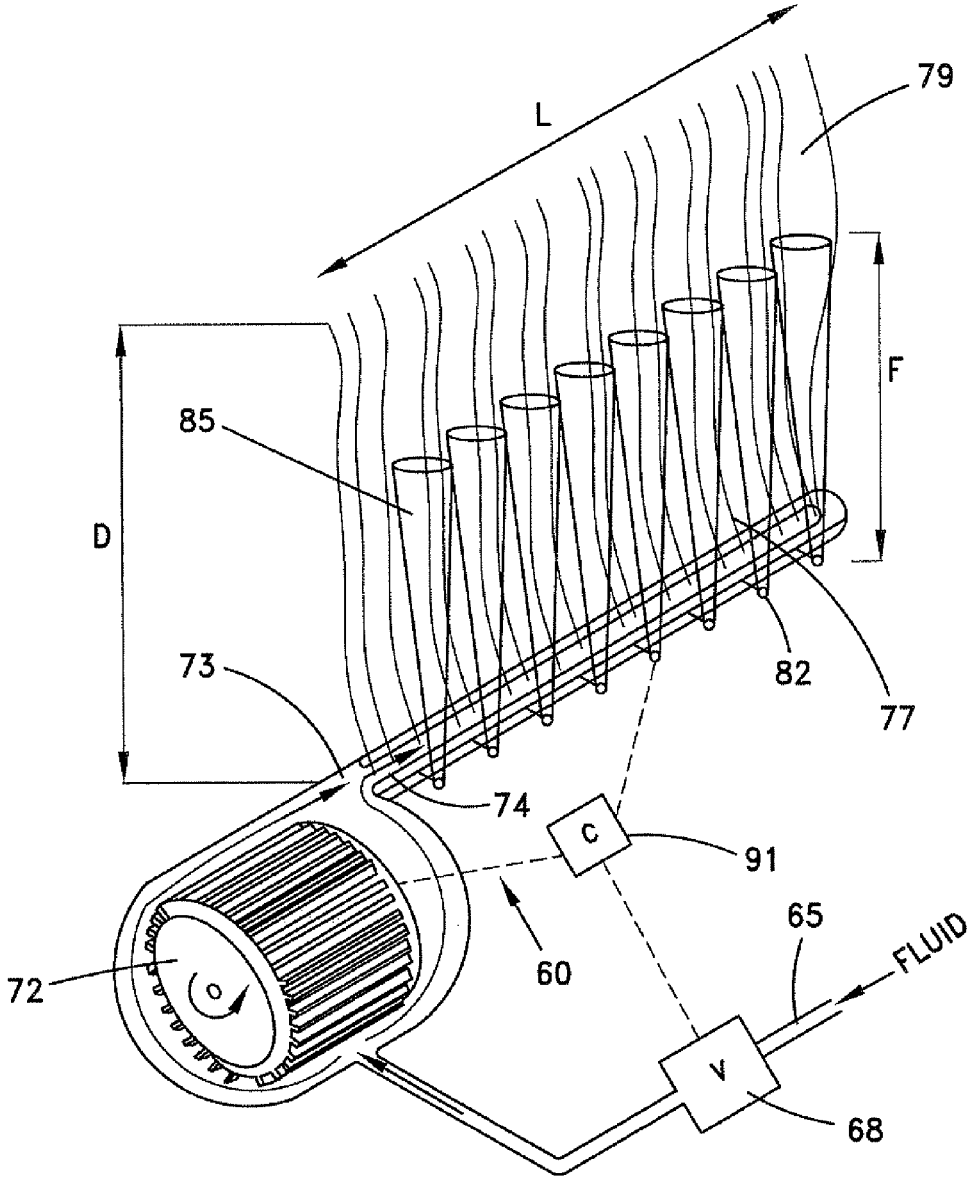
FIG. 5 is a schematic, partially schematic view of fog generating apparatus, according to one embodiment of the invention.

FIG. 5 schematically illustrates an apparatus 60 for generating a fog screen 79. Fog screen generating apparatus 60 comprises a line 65 through which fluid suitable for producing a fog flows, e.g. by means of a pump and of a reservoir containing the fluid, vaporizer 68 for vaporizing the fluid, axial flow blower 72 for increasing the pressure of the vaporized fluid so that the latter may be propelled at a distance, a transport conduit 74 collinearly extending from the exit 73 of blower 72, and a plurality of outlets 77 in fluid communication with transport conduit 74. The fluid is preferably environmentally safe. Exemplary fog screen generating apparatus is the Base Touring model manufactured by Hazebase, Wedemark, Germany.

Figure 6:
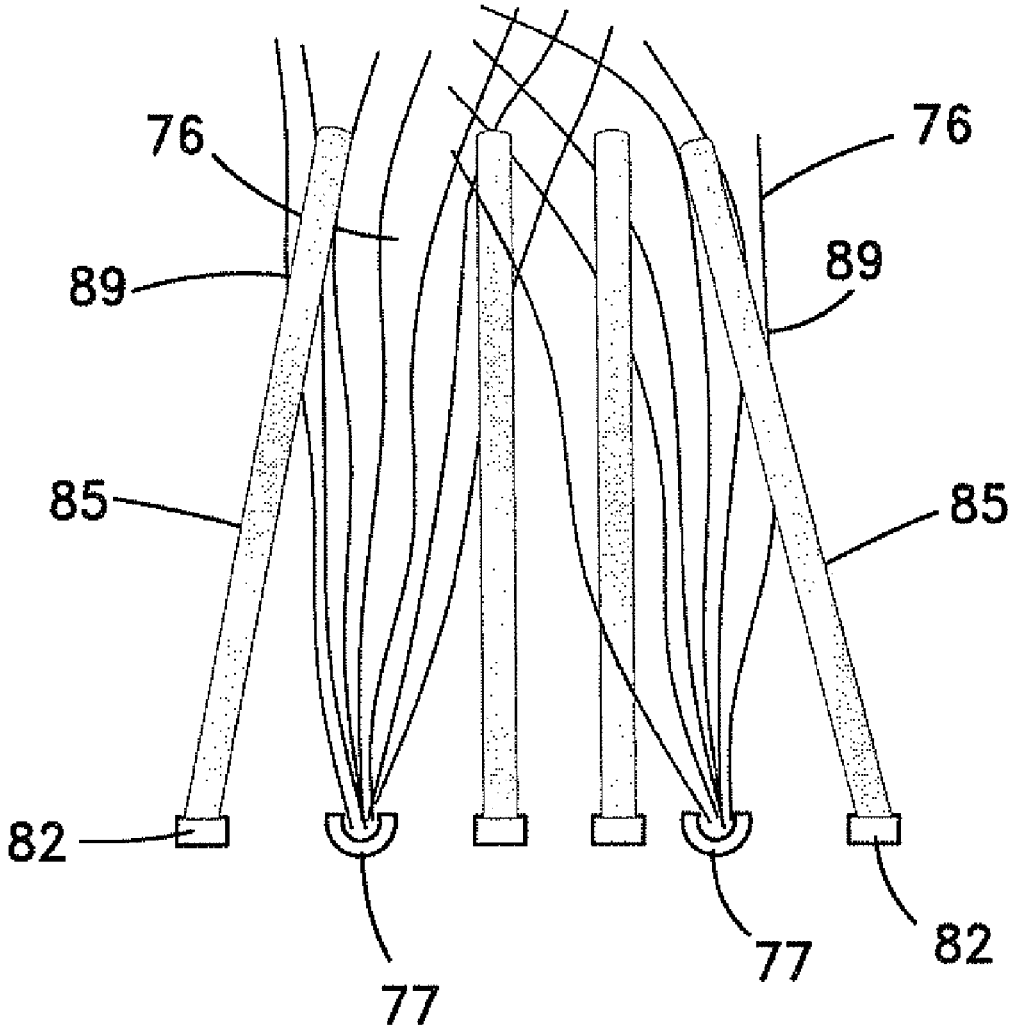
FIG. 6 is a schematic, front view of a portion of the apparatus of FIG. 5, showing the convergence of two fluid discharges to form a fog screen and of the impingement of generated light onto the fog screen.

With reference also to FIG. 6, the discharge 76 of vaporized and pressurized fluid exiting from a corresponding outlet 77, which may assume a conical pattern, converges with the fluid exiting an adjacent outlet to form fog screen 79 having a length L substantially equal to the length of the plurality of outlets 77 and a propelled dimension D, which is substantially perpendicular to conduit 74 and equal to the maximum distance from outlets 77 at which the pressurized vapor producing fog screen 79 remains undispersed.

A plurality of light sources 82 are deployed in the vicinity of conduit 74 such that the light 85 emitted from a corresponding light source propagates a distance F perpendicular to conduit 74, which may be different than dimension D, and impinges a corresponding vaporized fluid discharge 76. Light 85 is reflected or refracted by fluid discharge 76, and is therefore visible during bright daytime light. Apparatus 60 may comprise twice as many light sources 82 as fluid outlets 77 so that light 85 will impinge a corresponding lateral end 89 of the vaporized fluid discharge. If the fluid discharge were to slightly move laterally, for example as a result of a burst of wind, it would still remain illuminated by the light 85 emitted by an adjacent light source 82. It will be appreciated that any other number of light sources may be employed, and that the light sources may be directed at any other desired region of the vaporized fluid discharge. Two banks of light sources may be employed, one at each transversal end of conduit 74.

Fog screen generating apparatus 60 and light sources 82 are in electrical communication with a controller 91 for synchronizing the operation thereof. Substantially all of the fog screen 79 will therefore be illuminated, providing at a crossing a suddenly appearing wide-area image that is visible both during daytime and nighttime and that causes the viewer to instinctively react in anticipation of a potential or impending safety problem. Controller 91, which is in electrical communication with a switching device connected to one or more traffic lights and to one or more light sources as described hereinabove with respect to FIG. 2, may command fog screen generating apparatus 60 to operate only during the daytime.

Figure 7:
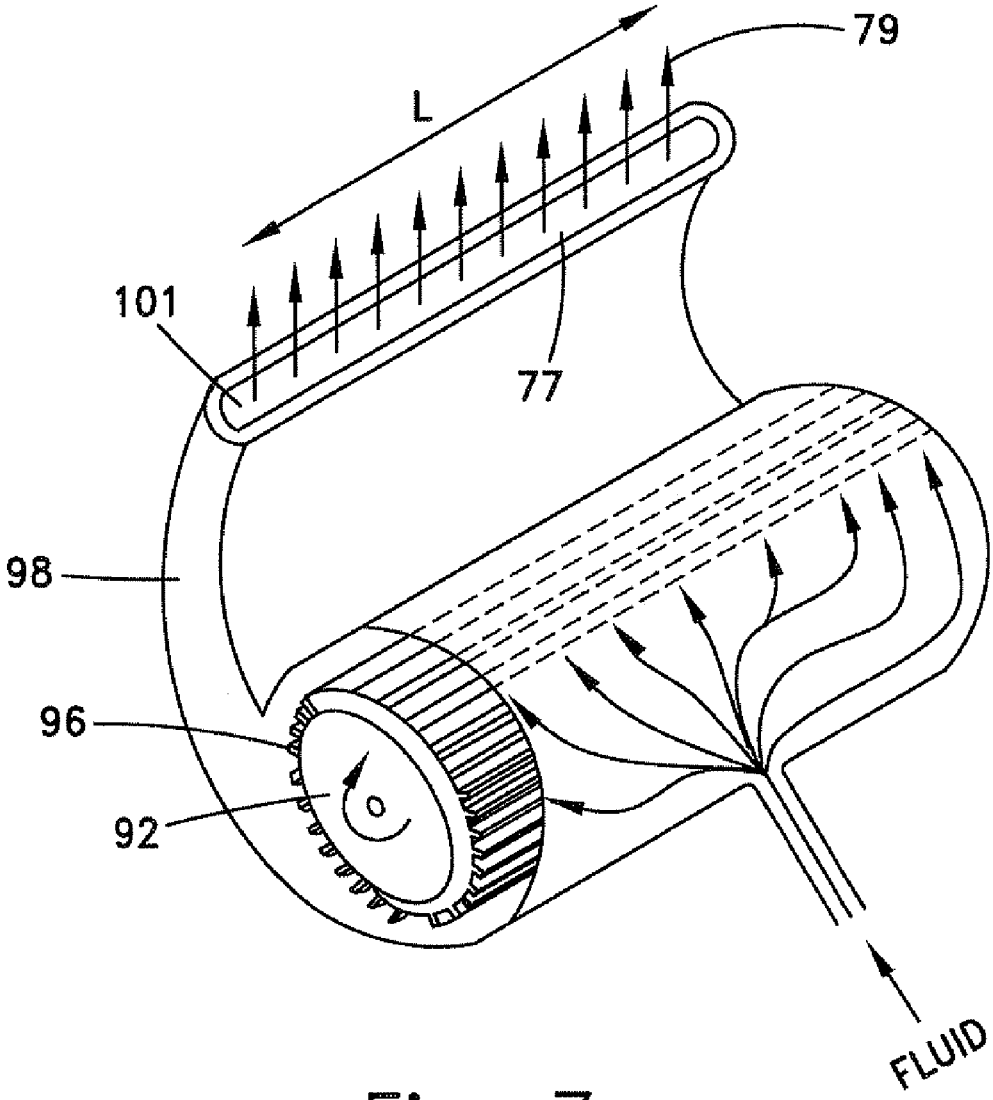
FIG. 7 is a schematic, partially schematic view of fog generating apparatus, according to another embodiment of the invention.

In order to increase the propelled dimension of the vaporized fluid discharge, a centrifugal blower 92 may be provided with elongated blades 96 and with an arcuate shroud 98 for guiding the vaporized and pressurized fluid exiting blades 96 to terminal end 101 of the shroud and to the plurality of outlets 77 formed therein or secured thereto, as illustrated in FIG. 7. Blades 96 are substantially of the same length L as fog screen 79. In addition to the length of blades 96, the propelled dimension of the vaporized fluid discharge is dependent on the rotational speed of blower 92, the flow rate of the fluid delivered to blower 96, and the viscosity of the fluid. The propelled dimension of the vaporized fluid discharge may also be increased by providing multi-staged fog screen generating apparatus.

Figure 8:
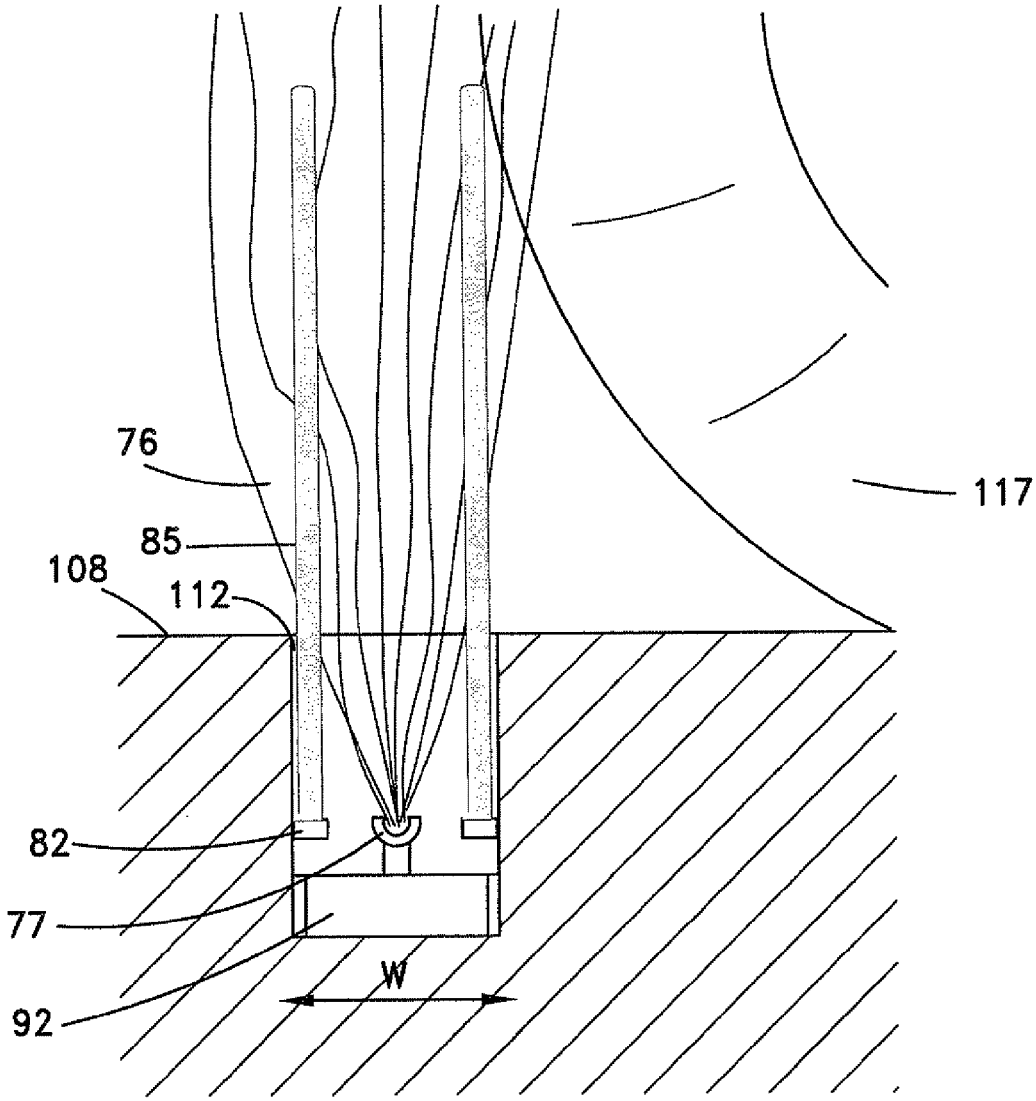
FIG. 8 is a vertical cross sectional view of a road surface in the vicinity of an intersection, showing a cavity in which is housed visible wide-area image generating apparatus and a motor vehicle tire approaching the cavity.

FIG. 8 illustrates a rectangular cavity 112 formed underneath a road surface 108 in which the wide-area image generating and fog screen generating apparatus are placed. The width W of cavity 112 is sufficiently large to allow the passage therethrough of vaporized fluid discharge exiting from a corresponding outlet 77 and light exiting from a corresponding source 82, yet is sufficiently small to prevent damage to a tire 117 of a motor vehicle traveling along road surface 108 while damping the shocks imposed by the motor vehicle. Blower 92 may be positioned within cavity 112 and below outlets 77 and light sources 82. The light sources 82 may be secured to the walls of cavity 112, or to any other convenient surface located therein. A sealing element and a drainage system (not shown) may also be provided within the cavity.

Figure 9:
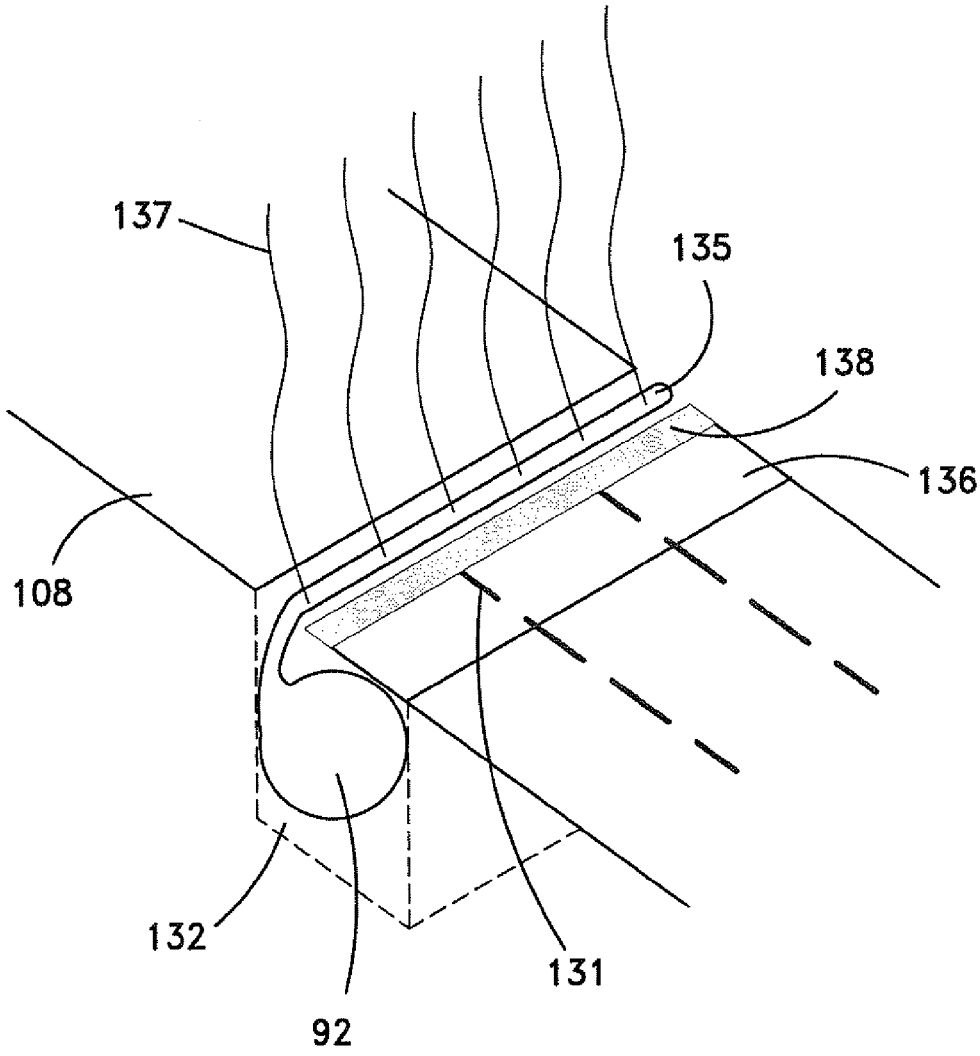
FIG. 9 is a perspective, schematic and vertical cross sectional view of a cavity for housing daytime visible wide-area image generating apparatus that is partially covered by a shield.

Alternatively as shown in FIG. 9, a rectangular or other shaped cavity 132 may be partially covered by metallic shield 136, in order to protect blower 92 housed therebelow. Slit 135, through which the fluid discharge and generated light pass to form wide-area image 137, is defined by the interspace between shield 136 and the remaining road surface 108. A stop line 138 may be applied to shield 136 so that motor vehicles will stop a predetermined distance before the formation of wide-area image 137. One or two lane divider lines 131 may also be applied to shield 136.

Figure 10:
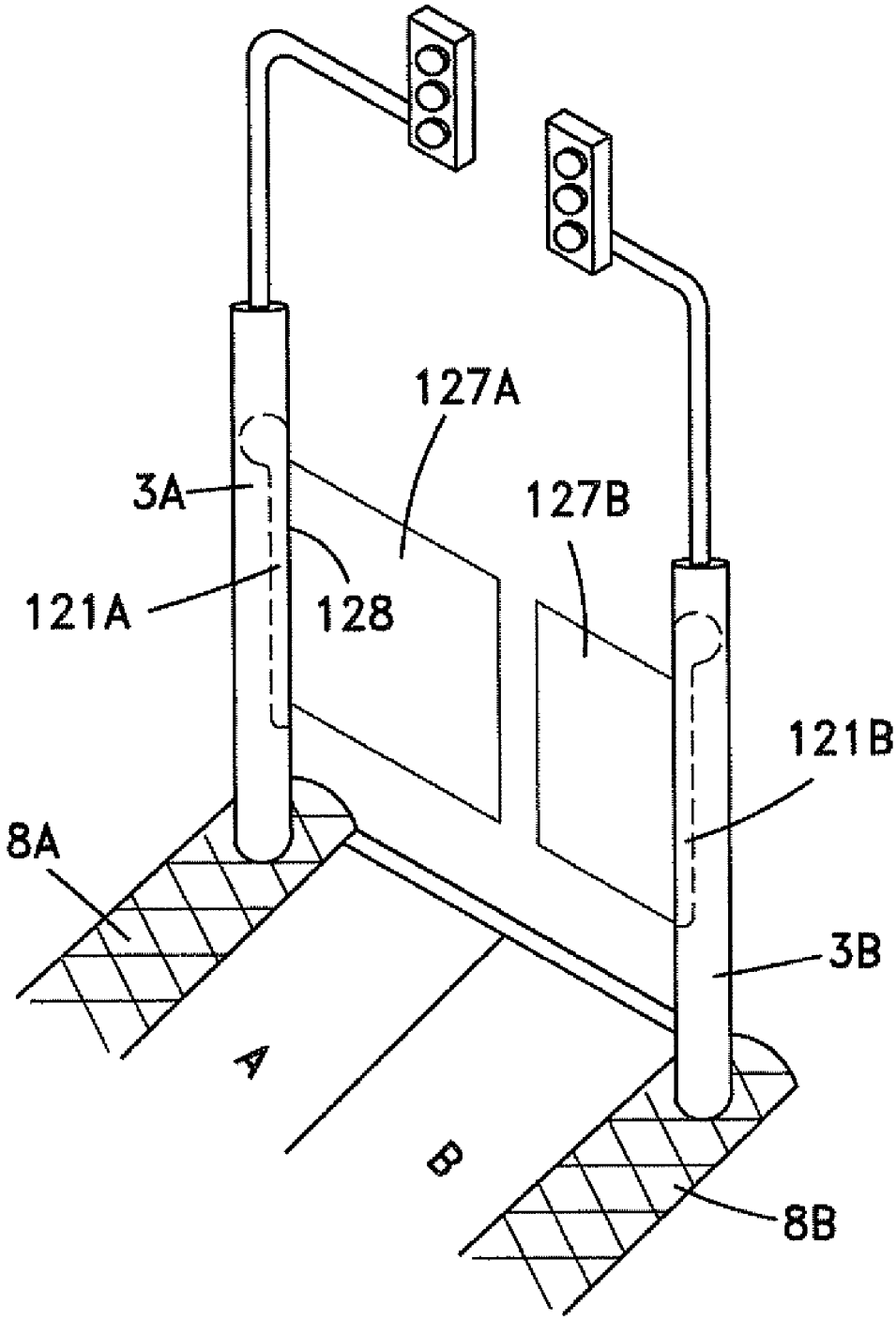
FIG. 10 is a perspective, schematic and vertical cross sectional view of a mounting pole in which is housed daytime visible wide-area image generating apparatus.

In the embodiment of FIG. 10, a unit in which are housed wide-area image generating and fog screen generating apparatus is mounted internally within a mounting pole, so that a wide-area image laterally extending from the mounting pole will be visible. Two of such units 121A and 121B may be mounted internally within mounting poles 3A and 3B, respectively, which in turn vertically extend from traffic islands 8A and 8B, respectively, so as to generate wide-area images 127A and 127B, respectively. These units, as well as the mounting poles, are formed with a slit 128 through which the fluid discharge and generated light pass.

In another embodiment of the invention, a wide-area image generating device is mounted onto a school bus. A wide-area image laterally extending from the school bus is generated when children are boarding, or disembarking from, the bus, to prevent a driver of a motor vehicle from injuring a child when subjected to sun glare, whereby the flashing lights of the bus, for example, are not visible.

Figure 11:
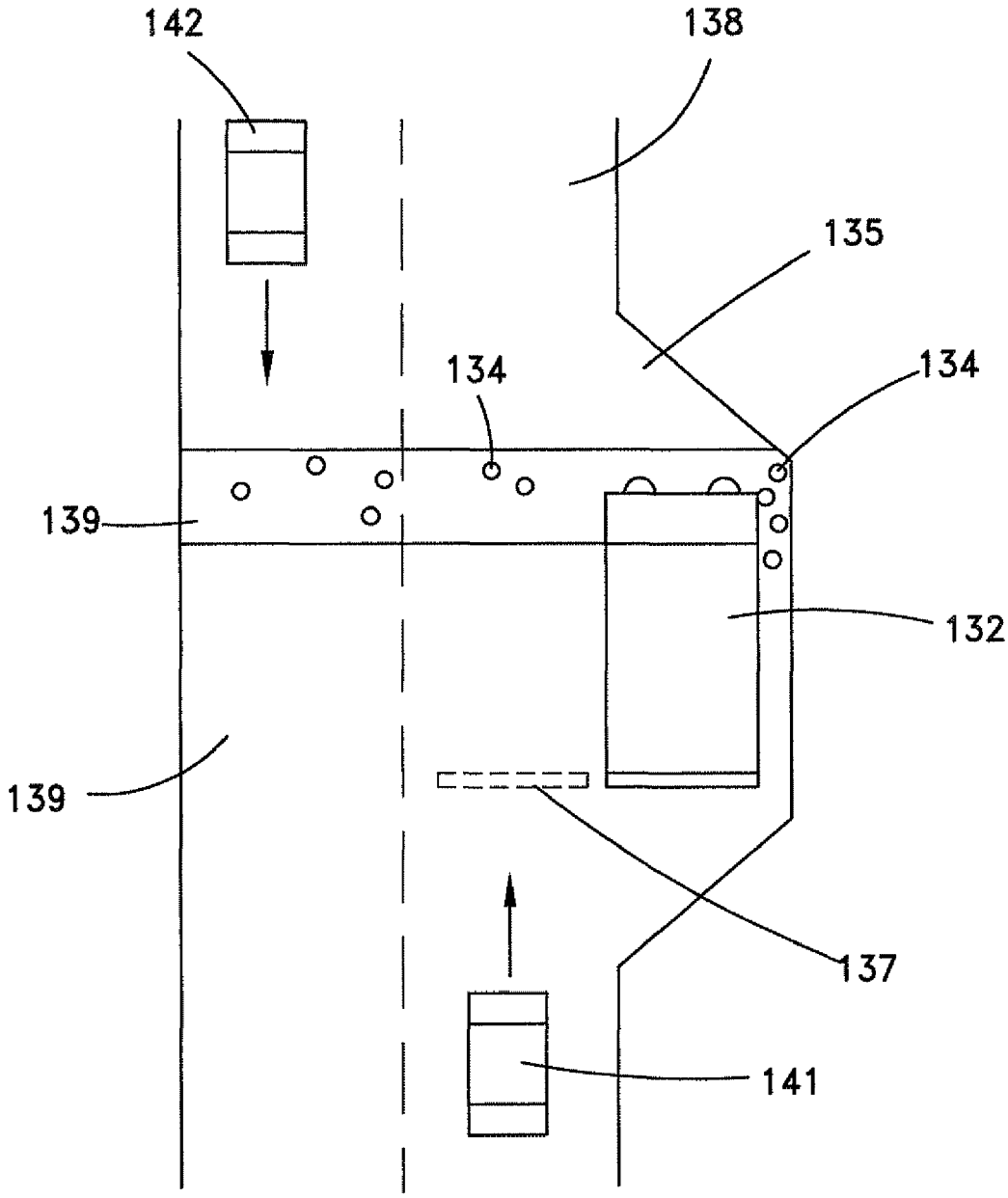
FIG. 11 is a schematic view of motor vehicles that have stopped in response to a wide-area image that has been generated by a school bus.

As shown in FIG. 11, a school bus 132 that has stopped in parking bay 135 being recessed from lane 138, or along the side of lane 138, to allow children 134 to embark or disembark will automatically generate a wide-area image 137 that laterally extends from the rear of the bus. Children traversing crosswalk 139 prior to embarking, or after disembarking from, school bus 132 constitute a safety hazard if drivers of nearby motor vehicles will not notice the flashing lights of school bus 132. Parking bay 135 and crosswalk 139 may therefore be considered a crossing. Wide-area image 137 is sufficiently large so that motor vehicle 141 located behind bus 132 and motor vehicle 142 traveling along lane 139 in an opposite direction as vehicle 141 will clearly see wide-area image 137 and stop.

Figure 12:
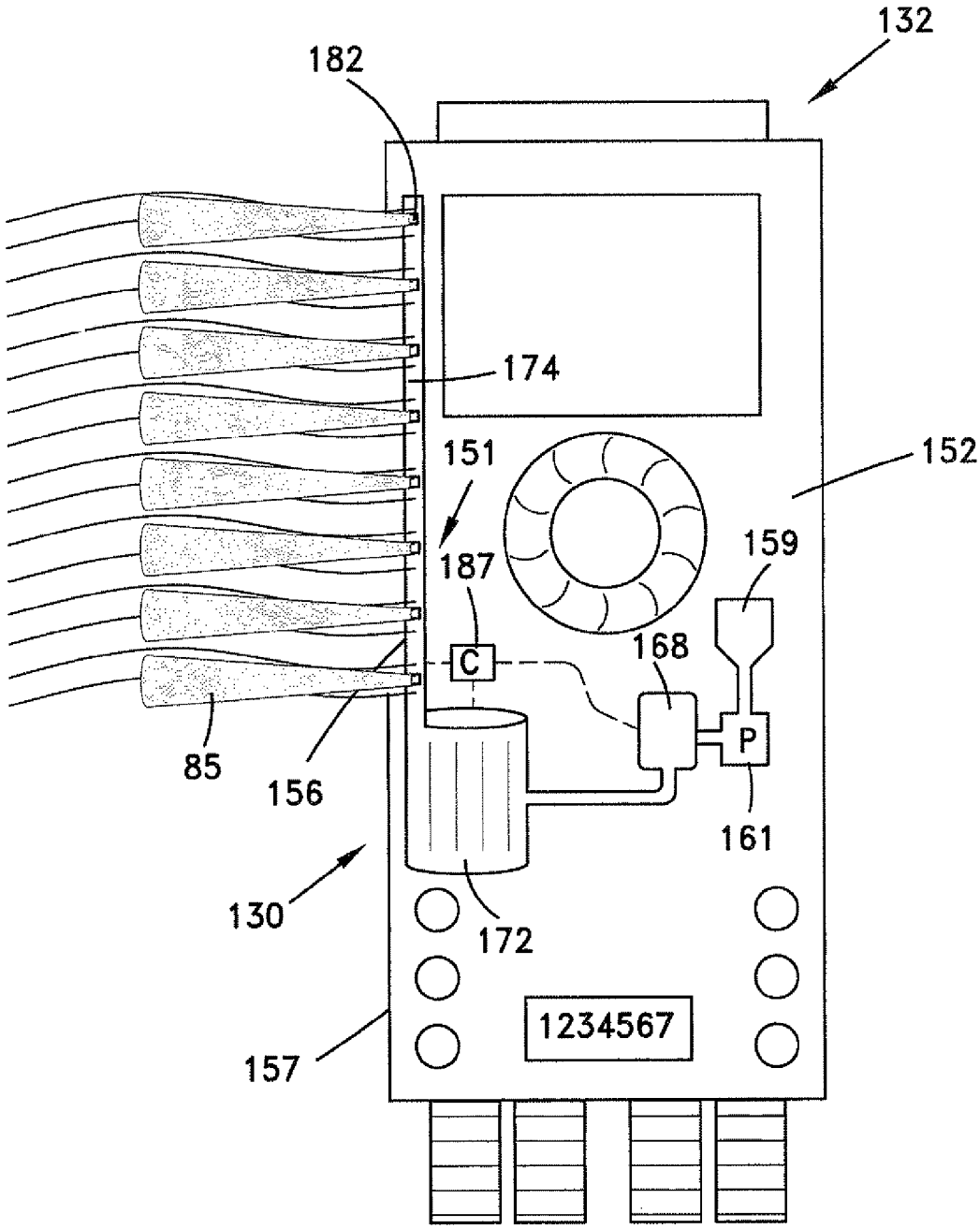
FIG. 12 is a schematic rear view of a school bus, illustrating the alert system that has been mounted therein.

FIG. 12 illustrates a school bus mounted alert system 130. Alert system 130 comprises unit 151 for generating a daytime visible wide-area image 137 and controller 187 for synchronizing operation of the wide-area image generating devices and the fog screen generating apparatus. Unit 151 comprising reservoir 159 for the fog producing fluid, pump 161 for delivering the fluid to vaporizer 168, axial flow blower 172 for pressurizing the vaporized fluid, conduit 174 provided with a plurality of outlets through which the pressurized vapor discharges, and a plurality of light sources 182 for emitting light 85 is mounted internally within rear wall 152 of school bus 132, or in any other convenient region thereof. Unit 151 may be retrofit to an existing school bus 132, or alternatively, the school bus may be manufactured together with unit 151. A slit 156, which may be automatically sealable, is formed in left wall 157 of school bus 132, to allow the passage therethrough of the fluid discharge and of the generated light, thereby generating a daytime visible wide-area image 137.

Figure 13:
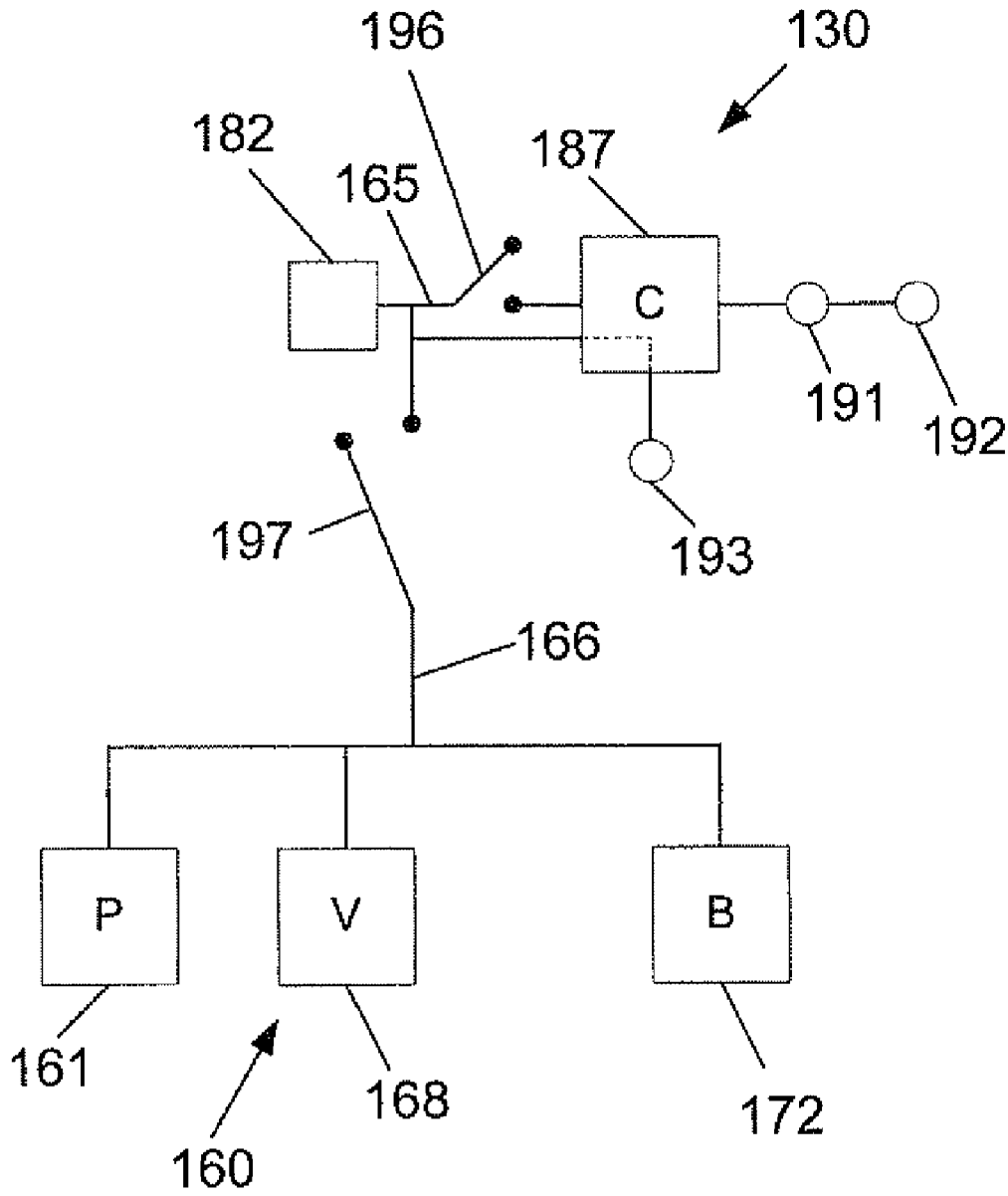
FIG. 13 is an exemplary wiring arrangement for the alert system of FIG. 12.

FIG. 13 is an exemplary wiring arrangement for alert system 130. Controller 187, which is in electrical communication in parallel with the plurality of light sources 182 with only one being illustrated and in parallel with the components of fog generating apparatus 160, e.g. pump 161, vaporizer 168, and blower 172, is connected in series with engine ignition sensor 191 and with door open sensor 192. Controller 187 will command switch 196 connected with light sources 182 by wire 165 and with the components of fog generating apparatus 160, by wire 166 branching from wire 165 to close upon receiving an input from each of sensors 191 and 192. Accordingly, in order to conserve energy and the fog producing fluid, light sources 182 for generating the wide-area image and the components of fog generating apparatus 160 will be activated only upon fulfillment of two conditions: (1) a door of the school bus is open to allow children to embark or disembark, and (2) the school bus engine is operational, indicating that the school bus will continue to travel when the doors are closed, that children in the vicinity of the school bus are in danger of being injured by local motor vehicles, and that the generation of a visible wide-area image to alert the drivers of the local motor vehicles is therefore of great importance.

In another embodiment of the invention, controller 187 is also connected to a light detector 193. When the ambient light level is less than a predetermined threshold as sensed by detector 193, such as during nighttime hours or periods of cloudiness or precipitation when visibility of a generated wide-area image will not be impaired, controller 187 will command switch 197 connected to branch 166 to be opened and to thereby deactivate the components of fog generating apparatus 160. However, when the ambient light level is greater than the predetermined threshold, the components of fog generating apparatus 160 will be activated, possibly with a delay. Alternatively, switch 197 may be manually opened, for example according to the discretion of the driver. Similarly, light sources 182 or fog generating apparatus 160 may be manually operated.

Figure 14:
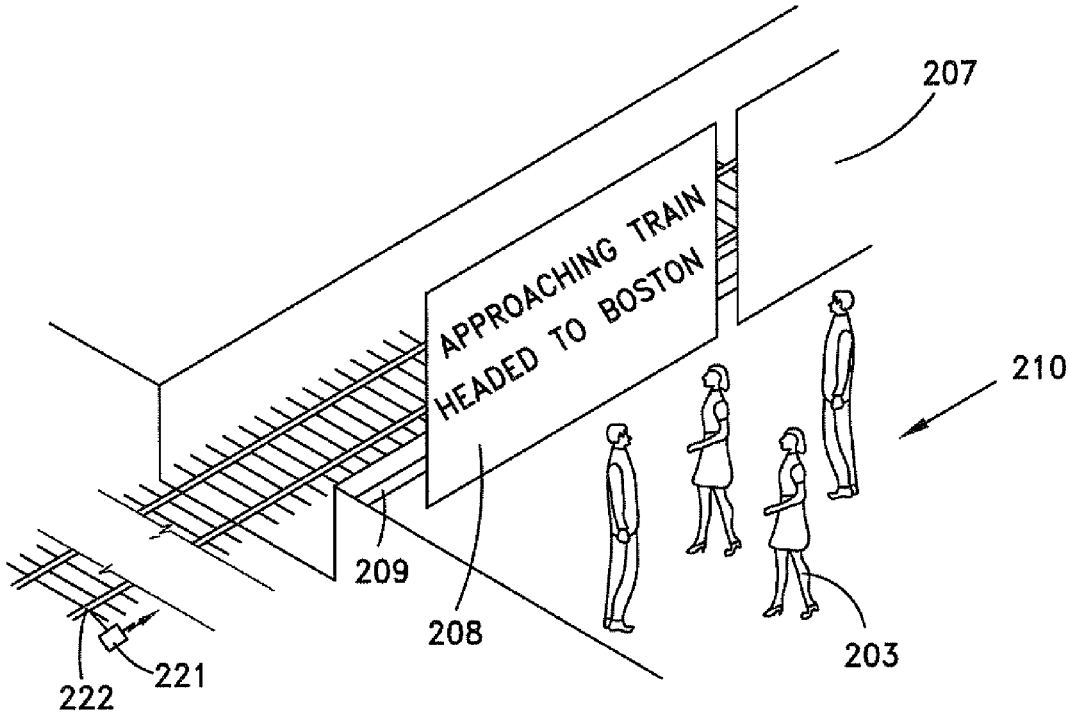
FIG. 14 schematically illustrates the generation of a wide-area image at a railcar station, schematically showing a crossing predictor component deployed at a rail portion distant from the station.

FIG. 14 illustrates the generation of a daytime visible wide-area image 207 by means of any wide-area image generating device and fog generating apparatus, if so desired, described hereinabove during the approach of a railcar, e.g. a train, subway and trolley, at a train station 210. Daytime visible wide-area image 207 is generated in front of warning line 209, so that passengers 203 will instinctively move away from the approaching railcar in order to avoid a fatal injury. If so desired, indicia 208 may appear on wide-area image 207. Indicia 208 may be in the form of a message, an advertisement, or be advertisement related.

In this embodiment, the controller is in communication, e.g. wireless communication, with a crossing predictor component 221, e.g. one that measures the change in inductance of an electrical rail 222 as the railcar passes the crossing predictor component. The controller receives a signal at a predetermined time before the railcar approaches station 210, whereupon the controller initiates the activation of the daytime visible wide-area image generating apparatus.

While some embodiments of the invention have been described by way of illustration, it will be apparent that the invention can be carried out with many modifications, variations and adaptations, such as visual messaging associated with advertising means, and with the use of numerous equivalents or alternative solutions that are within the scope of persons skilled in the art, without departing from the spirit of the invention or exceeding the scope of the claims.

The invention claimed is:

1. An alert system for generating, in the vicinity of a crossing, a wide-area image which is indicative of an actual or impending safety problem, comprising:

a) at least one safety indication component for indicating a state of an actual or impending safety problem;

b) at least one wide-area image generating device mounted in the vicinity of a crossing for generating a corresponding vertically appearing wide-area image that appears at an injury preventable distance from said crossing;

c) fog generating apparatus mounted in the vicinity of said crossing for discharging vaporized fluid by which light of said corresponding generated wide-area image is refracted or reflected, whereby each of said generated wide-area images is visible during daytime light; and d) a controller in communication with said at least one safety indication component for synchronizing operation of said at least one wide-area image generating device and said fog generating apparatus in response to a safety indication provided by said component, whereby at least one daytime visible wide-area image is generated at said injury preventable distance from said crossing so as to assist a viewer to respond in anticipation of said actual or impending safety problem.

2. The system according to claim 1, wherein the at least one safety indication component is a traffic light provided with a plurality of sequentially illuminating lamps, one or more of said traffic lights being deployed at an intersection, and the at least one daytime visible wide-area image is generated at the injury preventable distance from said intersection and appears above, and within the boundaries of, a corresponding lane passing through said intersection and that is indicative of the state of a corresponding traffic light, wherein a first wide-area image is displayable by means of a first wide-area image generating device in a first lane and a second wide-area image different from said first wide-area image is displayable by means of a second wide-area image generating device in a second lane adjacent to said first lane, vehicles traveling in said first and second lanes travel in the same direction.

3. The system according to claim 1, wherein each wide-area image generating device comprises one or more light emission units, each of said light emission units comprising a light source and means for directing the emitted light to the injury preventable distance from the crossing.

4. The system according to claim 3, wherein each light emission unit comprises a high-luminosity, non-coherent light source, and optical elements for focusing and reflecting the light from the light source along an axial direction to define a wide-area image having a predetermined width and height.

5. The system according to claim 3, wherein each light emission unit comprises a hologram generating unit, to define a wide-area image having a predetermined width and height.

6. The system according to claim 1, wherein each wide-area image generating device comprises a lens and a plurality of light-emitting diodes placed at the focal length of said lens.

7. The system according to claim 6, wherein the lens is a cylindrical lens or a spherical lens.

8. The system according to claim 2, wherein a generated wide-area image is indicative of the instantaneous state of a corresponding traffic light.

9. The system according to claim 2, wherein a generated wide-area image is indicative of a state to which a corresponding traffic light will be changed within a predetermined period of time.

10. The system according to claim 2, wherein the fog generating apparatus and the at least one wide-area image generating device are mounted within a traffic light mounting pole, the vaporized fluid and emitted light being laterally directed in such a way that the generated daytime visible wide-area image appears above, and within the boundaries of, a corresponding lane adjacent to the intersection.

11. The system according to claim 2, wherein the fog generating apparatus and the at least one wide-area image generating device are mounted within a cavity formed below a road surface in the vicinity of a stop line.

12. The system according to claim 2, wherein the fog generating apparatus and the at least one wide-area image generating device are mounted within a cavity formed below a road surface in the vicinity of a stop line.

13. The system according to claim 12, wherein the wide-area image generating device is adapted to generate a corresponding wide-area image that appears a predetermined distance before the stop line.

14. The system according to claim 1, further comprising a voice generating device in communication with the controller that is activated in response to a safety indication provided by the component.

15. The system according to claim 1, wherein the safety problem includes traffic barriers, tunnels, and obstacles on roads or on airports runways.

16. The system according to claim 1, wherein the crossing is a grade crossing or a pedestrian crossing.

17. The system according to claim 1, wherein the wide-area image is in the form of still or video images.

18. The system according to claim 1, further comprising a light detector, said light detector adapted to transmit a signal to the controller when a sensed light level is greater than a predetermined threshold, whereby to increase a level of current flowing through the wide-area image generating device and to increase the luminosity of the wide-area image.

19. The system according to claim 4, wherein indicia are displayable on a wide-area image foreground.

20. The system according to claim 2, wherein the controller is adapted to command the wide-area image generating device to generate a wide-area image of a different color than the lamp of the corresponding traffic light which is illuminated.

21. The system according to claim 1, wherein the fog generating apparatus and the at least one wide-area image generating device are mounted within a portion of a school bus and the at least one safety indication component includes an engine ignition sensor and a door open sensor, the fog generating apparatus and the at least one wide-area image generating device being operable to automatically generate a daytime visible wide-area image laterally extending from the school bus when the door of the school bus is open and the school bus engine is operational.

22. The system according to claim 1, wherein the at least one safety indication component is a crossing predictor component for determining an arrival time of a railcar at a station and the at least one daytime visible wide-area image is generatable at an injury preventable distance from a warning line of said station and at a predetermined time prior to said arrival time.

23. The system according to claim 18, wherein the light detector is adapted to transmit a signal to the controller when a sensed light level is less than a predetermined threshold, whereupon operation of the fog generating apparatus will be disabled in response to a safety indication provided by the component.

* * * * *